US010774276B2

(12) United States Patent
Alshareef

(10) Patent No.: US 10,774,276 B2
(45) Date of Patent: Sep. 15, 2020

(54) MULTI-STAGE FRACTIONATION OF FCC NAPHTHA WITH POST TREATMENT AND RECOVERY OF AROMATICS AND GASOLINE FRACTIONS

(71) Applicant: Saudi Arabian Oil Company, Dhahran (SA)

(72) Inventor: Ali H. Alshareef, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/155,267

(22) Filed: Oct. 9, 2018

(65) Prior Publication Data

US 2020/0109340 A1 Apr. 9, 2020

(51) Int. Cl.
*C10G 69/04* (2006.01)
*C10G 45/02* (2006.01)
(Continued)

(52) U.S. Cl.
CPC ..... *C10G 69/04* (2013.01); *C10G 7/02* (2013.01); *C10G 29/22* (2013.01); *C10G 45/02* (2013.01);
(Continued)

(58) Field of Classification Search
CPC ..... C10G 7/02; C10G 29/22; C10G 45/02; C10G 69/04; C10G 2300/104; C10G 2400/02; C10G 2400/30
See application file for complete search history.

(56) References Cited

U.S. PATENT DOCUMENTS 3,305,476 A 2/1967 York et al.
4,062,762 A 12/1977 Howard et al.
(Continued)

FOREIGN PATENT DOCUMENTS

IN 277492 B 5/2009
JP 6057266 A 3/1994

OTHER PUBLICATIONS

International Search Report and Written Opinion dated Nov. 19, 2019 in counterpart International application No. PCT/US2019/05820 filed Sep. 25, 2019.

*Primary Examiner* — Brian A McCaig
(74) *Attorney, Agent, or Firm* — Abelman, Frayne & Schwab

(57) ABSTRACT

A stream of cracked naphtha is fractionated into at least four specified fractions defined by their respective boiling point ranges. The lightest fraction, IBP to 50° C., is treated in a selective etherification or alkylation process to reduce its RVP value and increase its RON. The second fraction, 50° C. to 150° C., is selectively hydrogenated to treat and convert the diolefins present and the treated stream is sent directly to the gasoline blending pool since it has the desired RON and low sulfur content. The third, and optionally a fourth fraction, boiling in the range of 50° C. to 180° C., in an embodiment, are utilized for the production of aromatics and the raffinate stream, after aromatic extraction, is sent to the gasoline blending pool. A fraction of this latter stream can optionally be recycled for further cracking to produce additional aromatics and gasoline blending components. The heaviest fraction, 180° C. to MBP, constitutes a relatively small volume and is hydrotreated at high pressure, and one portion of the hydrotreated stream is recycled to the FCC unit for further processing and the remaining hydrotreated portion is sent to the gasoline blending pool.

32 Claims, 10 Drawing Sheets

(51) Int. Cl.
*C10G 7/02* (2006.01)
*C10G 29/22* (2006.01)

(52) U.S. Cl.
CPC ..... *C10G 2300/104* (2013.01); *C10G 2300/1044* (2013.01); *C10G 2400/02* (2013.01); *C10G 2400/30* (2013.01)

(56) References Cited

U.S. PATENT DOCUMENTS

| | | | | |
|---|---|---|---|---|
| 5,685,972 | A | 11/1997 | Timken et al. | |
| 9,434,894 | B2 | 9/2016 | Mehlberg et al. | |
| 2006/0086645 | A1 | 4/2006 | Rock et al. | |
| 2006/0180502 | A1* | 8/2006 | Boyer ..... | C10G 49/002 208/208 R |
| 2015/0368571 | A1* | 12/2015 | Mehlberg ..... | C10G 69/08 208/62 |
| 2015/0376515 | A1 | 12/2015 | Lim et al. | |

* cited by examiner

MULTI-STAGE FRACTIONATION OF FCC NAPHTHA WITH POST TREATMENT AND RECOVERY OF AROMATICS AND GASOLINE FRACTIONS

FIELD OF THE INVENTION

This disclosure is directed to processes for fractionating FCC naphtha followed by recovery and treatment of the fractions to provide aromatics and gasoline blending components of enhanced value.

BACKGROUND OF THE INVENTION

In order to maximize the production of gasoline, atmospheric distillation residue is typically subjected to vacuum distillation and the vacuum gas oil is cracked in a fluid catalytic cracking (FCC) unit or a hydrocracking unit operation to produce more gasoline-range products. FCC naphtha, coking unit or coker naphthas are commonly referred to as cracked naphtha and typically contain significant amounts of aromatics and olefins. Some refiners recover the cracked naphtha entirely for gasoline production and other refiners subject a portion of the cracked naphtha to aromatic extraction and utilize the remainder for gasoline production. A number of prior art publications and patents disclose processes for extracting the aromatics including benzene, toluene and xylene, commonly referred to as BTX.

Cracked naphtha from FCC or coking units is typically high in olefins and aromatics, but also high in sulfur- and nitrogen-containing compounds. FCC naphtha is used commercially for gasoline blending after hydrotreating, and the prior art includes a number of proposals for producing BTX and aromatics from this feedstock.

The fractionation of FCC naphtha on a limited scale has been disclosed in the prior art. A process in which the naphtha is split into at least two fractions is described in U.S. Pat. No. 9,434,894 (Mehlberg et al). This prior art process is schematically illustrated in FIG. 1 where the system (100) includes an FCC unit (110) producing an FCC naphtha stream (112) that is passed to splitter (120) from which the lightest fraction (122) containing C5 and C6 hydrocarbons and is sent directly to the gasoline blending pool. The second fraction (124), containing at least C6-C9 hydrocarbons is passed to a selective hydrogenation processing unit (130) to remove mercaptans and convert diolefins to mono-olefins (132) which are then passed to an aromatics extraction unit (150) to remove a portion or all of the aromatics from the selectively hydrogenated fraction. The aromatic-lean raffinate stream (152) from the aromatic extraction unit (150) that is rich in olefins and paraffins is sent to the gasoline blending pool (160). The heaviest fraction (126) from the FCC naphtha splitter (120) containing C10+ hydrocarbons is passed to hydrotreating unit (140) and the hydrotreated stream is sent to the gasoline blending pool.

Another prior art process disclosed in U.S. Pat. No. 5,685,972 to Timken et al is shown in the simplified schematic illustration of FIG. 2 where the system (200) includes an FCC unit (210) producing an FCC naphtha stream (212) that passes to splitter (220) that splits the FCC naphtha stream into two streams, one (222) having a boiling point of less than 170° F. and the second (224) having a boiling point greater than 170° F. (~77° C.). The lower boiling lighter fraction (222) is sent directly to the gasoline blending pool (270) while the heavier fraction (224) is passed to hydrodesulfurization unit ((230) and, optionally, passed to an octane recovery reactor (240) containing zeolite catalyst or, alternatively, transferred to distillation unit (250) for recovery of a 170° to 300° F. (~77° C. to ~150° C.) fraction (252) that is passed to BTX extraction unit (260), and a 300° F.+ (~149° C.) fraction (254) that is sent to the gasoline blending pool (270). The raffinate stream (264) following BTX extraction is also sent to the gasoline blending pool (270).

Although the prior art processes described above provide some advantages in processing FCC naphtha streams, additional problems are faced by refiners utilizing existing FCC units and the need exists for an improved process and system for increasing the efficiency of recovering gasoline blending pool components from FCC naphtha streams, and to thereby increase the overall value of the FCC naphtha by improving the quality and performance characteristics of the products recovered.

SUMMARY OF THE INVENTION

The above problems are resolved and additional advantages are realized by the process of the present disclosure which is directed to maximizing the value of FCC naphtha by fractionating the cracked naphtha stream and separating it into at least four distinct fractions, and optionally five fractions, based upon specified boiling point ranges. Hydrotreating costs can be optimized by fractionating the FCC naphtha into the fractions as described herein and treating each specified fraction separately, based upon its composition. This permits each of the different fractions to be processed under conditions that are optimized to improve the overall efficiency of the integrated process. The practice of the process provides the refiner with the ability to optimize the process by fractionating the FCC naphtha into the fractions specified below so that each fraction can be treated separately and provides the refiner with added flexibility in obtaining the desired slate of blending components.

The process of the present disclosure broadly comprehends the treating of an FCC naphtha or cracked naphtha to produce aromatics and components for gasoline blending, comprising:

a. fractionating the cracked naphtha in a fractionating column into five fractions based on boiling points, whereby the lightest fraction having a predetermined boiling point below 50° C. contains no aromatics and a substantial proportion of olefins that can include C4-C7 components, a second fraction with an initial boiling point which is the same as the final boiling point of the first fraction and a final boiling point of 100° C., a third fraction with an initial boiling point which is the same as the final boiling point of the second fraction and a final boiling point of up to 150° C., a fourth fraction with an initial boiling point which is the same as the final boiling point of the third fraction and a final boiling point of up to 180° C., and a fifth fraction with an initial boiling point which is the same as the final boiling point of the fourth fraction and a final boiling point that is the MBP of the feed entering the fractionation column;

b. passing the first fraction to a processing unit to reduce the RVP value of the fraction and then passing the treated stream to the gasoline blending pool;

c. passing the second fraction to a selective hydrogenation processing unit;

d. passing the selectively hydrogenated product to the gasoline blending pool;

e. passing the third fraction to an aromatics extraction unit;

f. passing the fourth fraction to a hydrotreating unit and mixing it with the product of step (e) prior to feeding the mixture to the aromatics extraction unit;

g. separating the stream recovered from the aromatic extraction unit into an aromatic-rich stream which is recovered for further aromatic processing, and an aromatic-lean stream comprised principally of paraffins, isoparaffins and olefins which is passed to a hydrotreating unit and passing the hydrotreated stream to the gasoline blending pool;

h. passing the fifth fraction for hydroconversion and recycling a portion or all of the hydroconverted product to both or either of the FCC unit and the remaining portions to the gasoline pool.

In the practice of an alternative embodiment of the process, the first fraction is that which has the initial boiling point (IBP) of the cracked naphtha feedstream and boiling up to about 50° C., that is, boiling at approximately 50° C. and below; the second fraction boils in the range of from about 50° C. up to about 150° C.; the third fraction recovered boils in the range from about 150° C. to about 180° C.; and the fourth fraction boils from about 180° C. up to the maximum boiling point (MBP) of the feedstream.

These fractions as defined above by their boiling point ranges are treated as follows:

a. the first and lightest fraction (IBP to 50° C.) is subjected to a selective etherification process or an alkylation process to reduce its Reid vapor pressure (RVP) value and to increase its research octane number (RON);

b. the second fraction (50° C. to 150° C.) is selectively hydrogenated to convert diolefins to mono-olefins after which the treated stream is passed to a splitter from which a 50° C. to 100° C. boiling portion is sent directly to the gasoline blending pool since it has an excellent RON value and a low sulfur content, and the portion boiling in the range from about 100° C. to 150° C. is passed to an aromatic extraction unit where the aromatics are recovered for further processing and the raffinate is passed to a hydrotreating unit and the hydrotreated product is sent to the gasoline blending pool;

c. the third fraction (150° C. to 180° C.) is initially hydrotreated and the hydrotreated product is passed to the aromatic extraction process and passed as in step (b);

d. the fourth and heaviest fraction (180° C. to MBP) is hydrotreated at high pressure, which is economically practical due to the relatively small volume of this fraction, and the hydrotreated product is divided into a first portion which is sent to the gasoline blending pool and a second portion which is recycled to the FCC unit for further processing.

The present process improves the efficiency of the hydrotreating process by limiting the fraction based on boiling point to those products that require hydrotreating, thereby maximizing utilization and through-put of the hydrotreating unit.

High efficiencies in the aromatics separation step can be achieved with known solvent extraction processes which remove 98-99 wt % of the aromatics, with the aromatics-lean stream comprised of from 98-99 wt % of paraffins, isoparaffins and olefins. Solvents suitable for use in the aromatics extraction process include sulfolane, mono-ethylene glycols including diethylene and tetraethylene glycols, and dimethyl sulfoxide, alone and in combination.

As will be understood by those of ordinary skill in the art, the ability to recover a fraction with the desired lower and/or upper ranges depends upon the skill of the operator and the operating characteristic of the distillation apparatus. The temperatures and boiling ranges specified in this description and in the claims will therefore be understood by one of ordinary skill in the art to be the desired operating cut points and that some operational variations can be expected without departing from the scope of the invention. Temperature variations of ±5° C. are within the foreseeable results of equipment and operational variables during the practice of the claimed process.

In accordance with the present process, the value of the FCC naphtha, or cracked naphtha in general, is maximized by maximizing the volume of the aromatics extracted and the gasoline or gasoline blending components produced. The quality of the gasoline blending stock produced is improved in terms of a reduction in the undesirable sulfur- and nitrogen-containing compounds and in an embodiment a decrease in the RVP value.

The process of the disclosure broadly comprehends fractionating a stream of cracked naphtha into at least four specified fractions defined by their respective boiling point ranges. The lightest fraction, IBP to 50° C., in an embodiment is treated in a selective etherification process to reduce its RVP value and increase its RON. The next fraction, 50° C. to 150° C., is selectively hydrogenated to convert the diolefins present to mono-olefins and the treated stream is sent directly to the gasoline blending pool since it has the desired RON and low sulfur content. The third, and optionally the fourth fraction, 150° C. to 180° C., in an embodiment, are utilized for the recovery of aromatics and the aromatic-lean raffinate stream, after aromatic extraction, is sent to the gasoline blending pool. A fraction of the raffinate stream can optionally be recycled for further cracking to produce additional aromatics, with the remainder passed to the gasoline blending pool. The heaviest fraction, boiling from 180° C. to the maximum boiling point (MBP), constitutes a relatively small volume and is hydrotreated at high pressure, and one portion of the hydrotreated stream is recycled to the FCC unit for further processing and the remaining hydrotreated portion is sent to the gasoline blending pool.

The fraction subjected to the alkylation or etherification process is limited to the maximum boiling point of 50° C. since the heavier fractions will not benefit from the process. As will be understood by those of ordinary skill in the art, an important characteristic of gasoline is its Reid vapor pressure (RVP) which is a measure of its volatility or how easily it evaporates. The refiner determines the RVP, among other characteristics, of the gasoline pool in order to assure that it meets the required specifications. Where the RVP for a particular blending fraction is high, the refiner has the option of passing all or a portion of that fraction to an alkylation unit or a selective etherification unit to reduce the RVP. In the process of the present disclosure, the lightest fraction has a very high RVP and can be treated, e.g., in an alkylation or etherification step, if the RVP of the blend exceeds the specification. As a bonus, the treated stream will also undergo an increase in octane and exhibit a higher RON than the original fraction.

By limiting the etherification process to the first fraction, the capacity of the unit is better utilized and provides the ability to process a greater volume of the feed that will benefit most significantly from the etherification. The very light fractions below 50° C. need not be cracked and it can be passed directly to the gasoline blending pool.

BRIEF DESCRIPTION OF THE DRAWINGS

The invention will be described in further detail below and with reference to the attached drawings in which the same or similar elements are identified by the same numeral, and where.

DETAILED DESCRIPTION OF THE INVENTION

Figure 1:
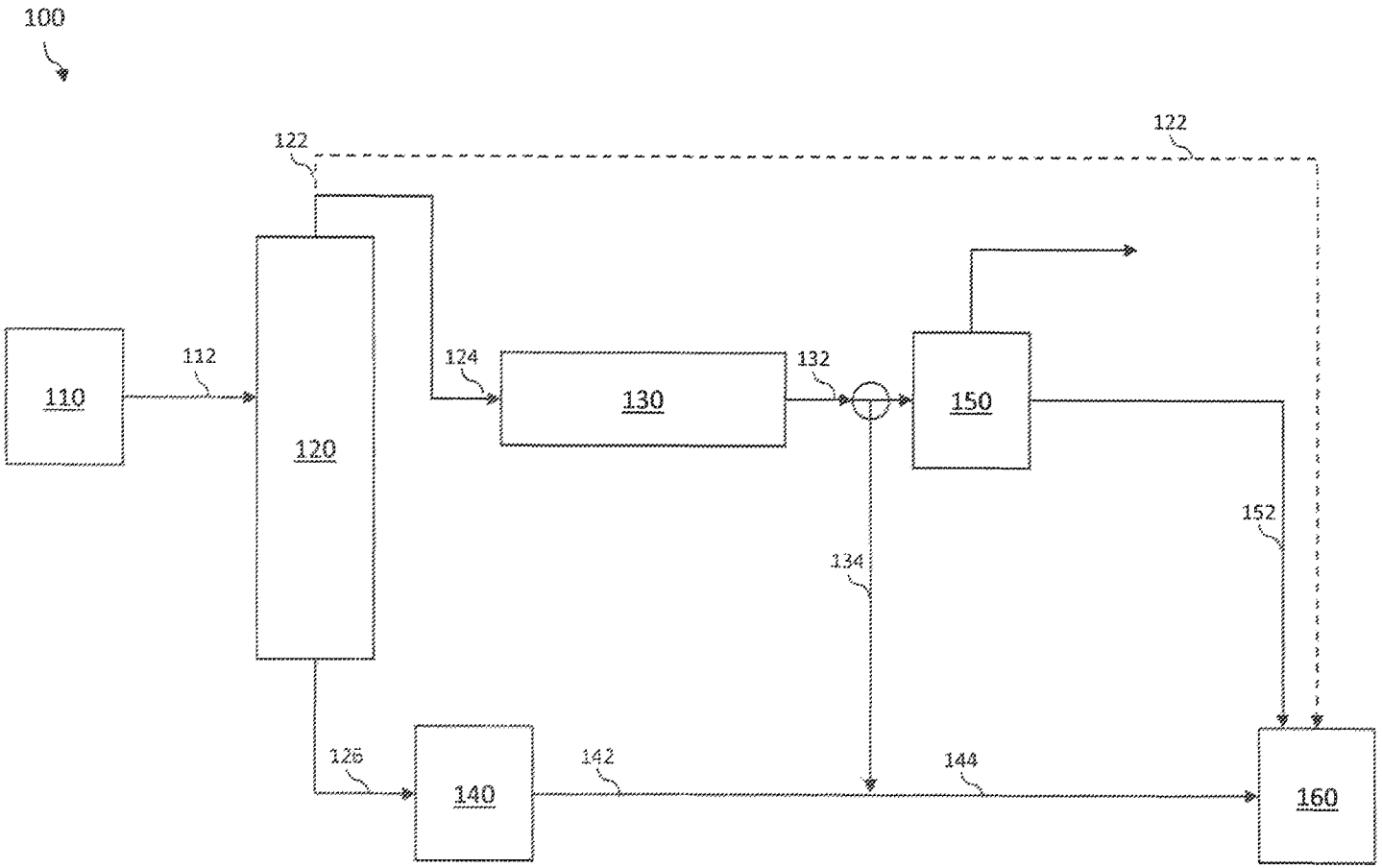
FIG. 1 PRIOR ART
FIG. 1 is a simplified schematic diagram of a system and process of the prior art for treating a cracked naphtha stream for the recovery of gasoline blending components described in U.S. Pat. No. 9,434,894 (Mehlberg et al)
Figure 2:
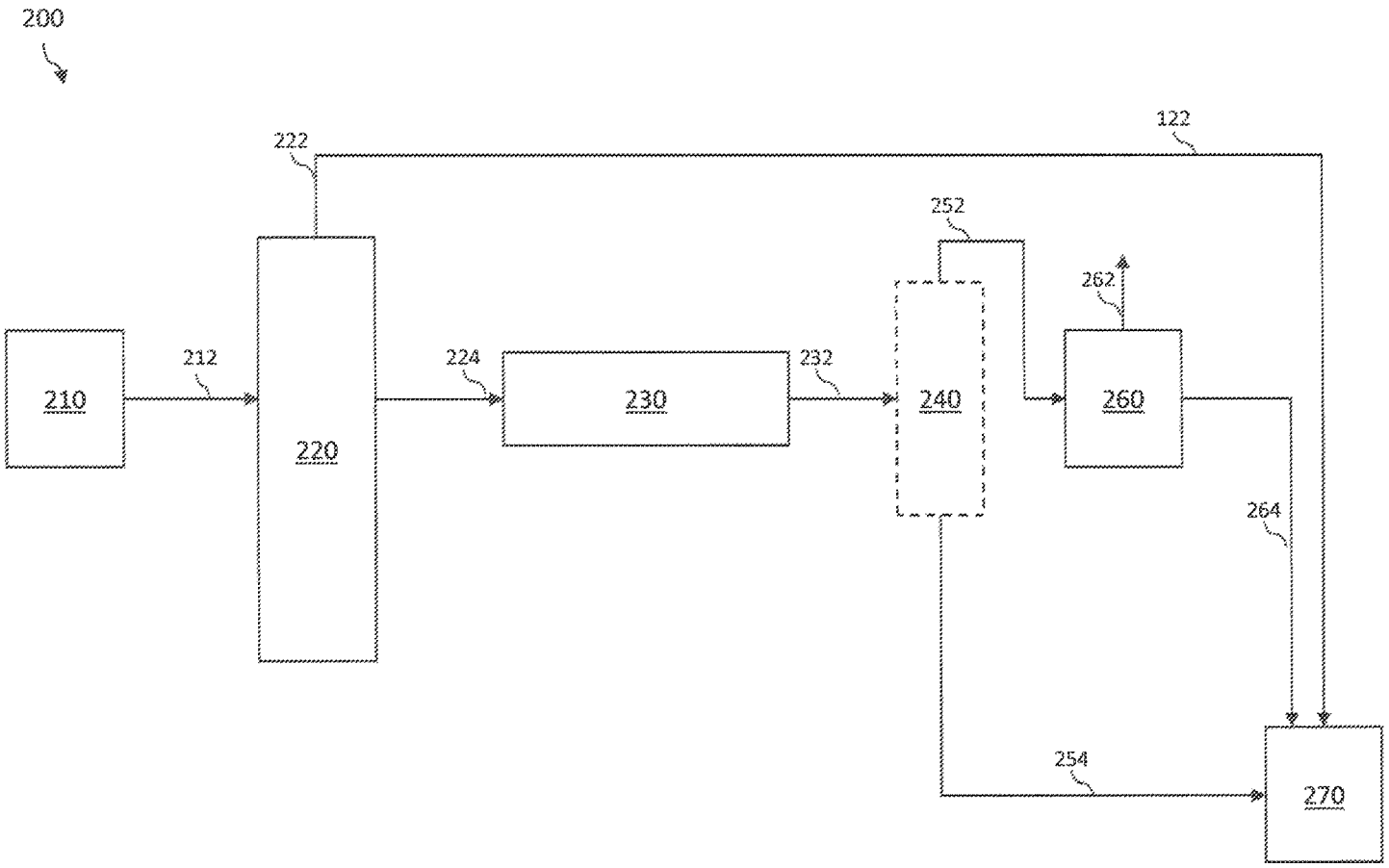
FIG. 2 PRIOR ART
FIG. 2 is a simplified schematic diagram of a system and process of the prior art for treating a cracked naphtha stream for the recovery of gasoline blending components described in U.S. Pat. No. 5,685,972 (Timken et al)

An embodiment of the disclosure will be described with reference to the simplified schematic flow diagram of FIG. 3. The system (300) includes FCC unit (310) from which is recovered an FCC naphtha, or cracked naphtha stream (312) which is passed to distillation column (320) which is configured and operated for the recovery of at least five separate streams at the closely controlled cut points described above and in more detail below.

The first and lightest fraction (322) includes material boiling from the initial boiling point (IBP) up to 50° C. and is passed to processing zone (330) where it undergoes a selective etherification or alkylation process to reduce its Reid vapor pressure (RVP) value and to increase its research octane number (RON). The treated product (332) is then passed to the gasoline blending pool (390).

The second fraction (324), boiling in the range of from 50° C. to 100° C. is passed to the selective hydrogenation zone (340) where it is subjected to selective catalytic hydrogenation using appropriate catalysts to convert diolefins, or dienes, to mono-olefins after which the treated stream is sent directly to the gasoline blending pool (390). For reasons that will be discussed in more detail below, this second fraction (324) has an excellent RON value and a relatively low sulfur content.

The third fraction (326), boiling in the range of from 100° C. to 150° C. is passed to an aromatic extraction zone (370) which can comprise a solvent extraction unit which includes means for separating the aromatics from the solvent and recovery of the aromatics (372) for further processing in a downstream unit (376). The aromatic-lean raffinate stream (374) which is composed principally of paraffins, isoparaffins and olefins is passed to a hydrotreating zone (380B) and the hydrotreated product (382) is passed to the gasoline blending pool (390). Also shown in FIG. 3, in an alternative embodiment, the third fraction (326) is passed directly to a hydrotreating zone (380A) upstream of the aromatic extraction zone (370).

The fourth fraction (328) boiling from 150° C. to 180° C. is passed to a hydrotreating zone (350) and the hydrotreated stream (352) is passed to the aromatic extraction zone (370) where it is processed with the third fraction (326). This fourth fraction is high in aromatic content, with more than 30% of the weight percent of aromatics present in the 100° C. to 150° C. fraction (326).

The fifth and final fraction (329) comprises those components boiling at 180° C. and up to the maximum boiling point (MBP) of the cracked naphtha feed. The final fraction which is passed to high pressure hydroprocessing zone (360) for appropriate treatment depending upon the composition of the fraction. A portion of the hydrotreated material can be sent to the gasoline blending pool (390), and the remaining stream (364) recycled to the FCC unit (310) where it is combined with the fresh feed to the unit.

Figure 3:
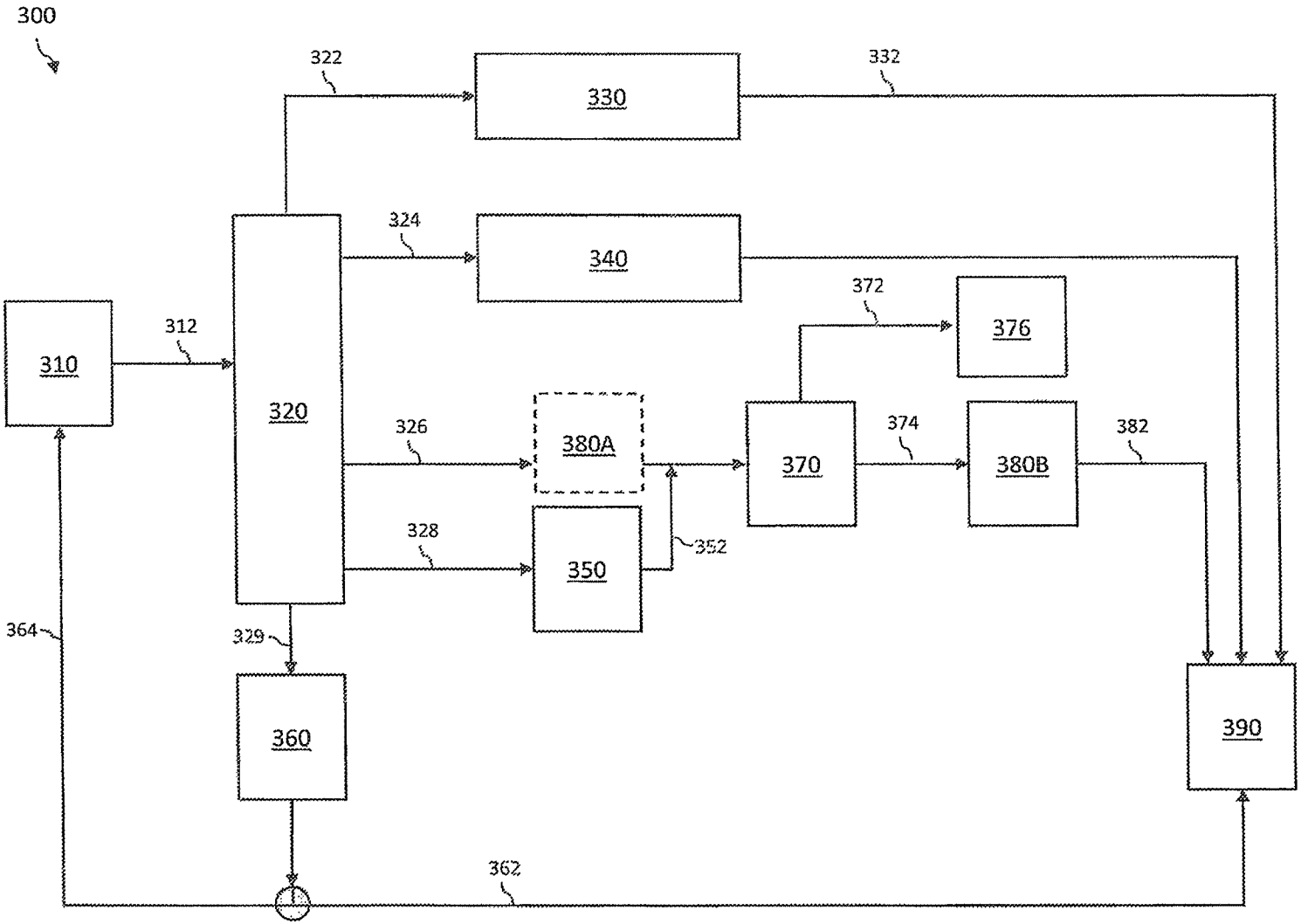
FIG. 3 is a simplified schematic diagram of a system and process in accordance with an embodiment of the present disclosure for maximizing the production of gasoline blending pool components from a cracked naphtha stream.
Figure 3A:
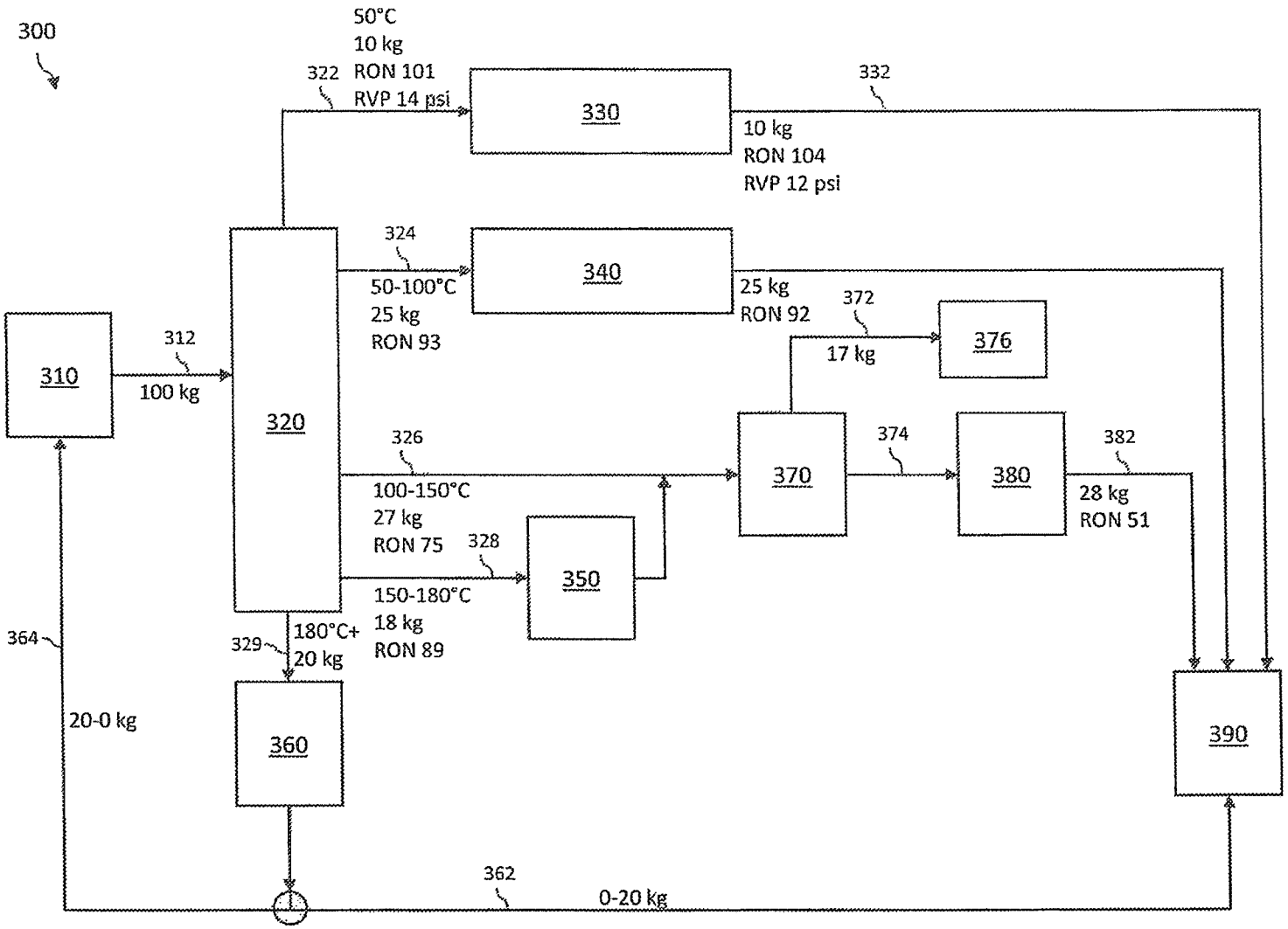
FIG. 3A is a schematic diagram of the system and process of FIG. 3 that includes a material balance, and RON and RVP values for the indicated streams.

Referring now to FIG. 3A, the system and process illustrated in FIG. 3 is reproduced with the material balances for each stream indicated based upon an original cracked naphtha feed of 100 kg. As shown by this analysis, the aromatic stream (372) recovered from the aromatic extraction zone (370) amounts to 17 kg or 17 weight % of the original FCC naphtha stream.

With continuing reference to FIG. 3, the following typical operating conditions are provided for the respective unit operations identified by name and the corresponding element number. The selective etherification (330) can proceed at a temperature in the range of from 20° to 80° C. and employ methanol as a solvent. The alternative alkylation process (330) can operate in a temperature range of from 20° to 50° C. with strong acids, e.g., sulfuric acid or hydrofluoric acid, where the most preferred temperature depends on the solvent, with the typical range being from 25° to 40° C. The selective hydrogenation process (340) can be conducted under mild hydrotreating conditions to selectively hydrogenate diolefins, with a suitable temperature range being from 45° to 250° C., preferably between 100° to 200° C., and at a pressure ranging from 1500 to 5000 kpa, and preferably at about 2500 kpa. The initial hydrotreating (between 150° and 180° C.) where the feed typically contains a low level of nitrogen compounds, i.e., less than 10 ppm, and a low sulfur content, e.g., less than 2000 ppm, the temperature can range from 250° to 350° C., and preferably at about 330° C.; an operating pressure between 20 and 40 bar, and preferably at about 30 bar; with a ratio of hydrogen/hydrocarbons of 150 to 300 and preferably about 200; and a liquid hourly space velocity of 1 to 5, and preferably 2 LHSV. The hydroconversion unit (360) which can be a hydrogenation unit, a hydrotreating unit or a hydrocracking unit, typically receives a feed with high nitrogen content, e.g., more than 50 ppm and a sulfur content higher than 5000 ppm or 0.5%; operates at a temperature between 300° and 400° C., preferably 370° C.; a pressure in the range of 30 to 60 bar, preferably 40 bar; with a hydrogen/hydrocarbon ratio from 200 to 1000, preferably 500; and a liquid hourly space velocity (LHSV) of 0.1 to 5. The aromatics extraction unit (370) can operate at a temperature of from 50° to 150° C., with the preferred temperature being dependent upon the solvent used, e.g., for sulfolane about 120° C. The mild hydrotreating process (380) operates under conditions similar to the initial hydrotreating unit (350) as described above, with preferred conditions being at the lower end of the ranges recited, e.g., a temperature of about 300° C., an operating pressure of 25 bar, H/HC of 200 and an LHSV of 2.

Figure 4:
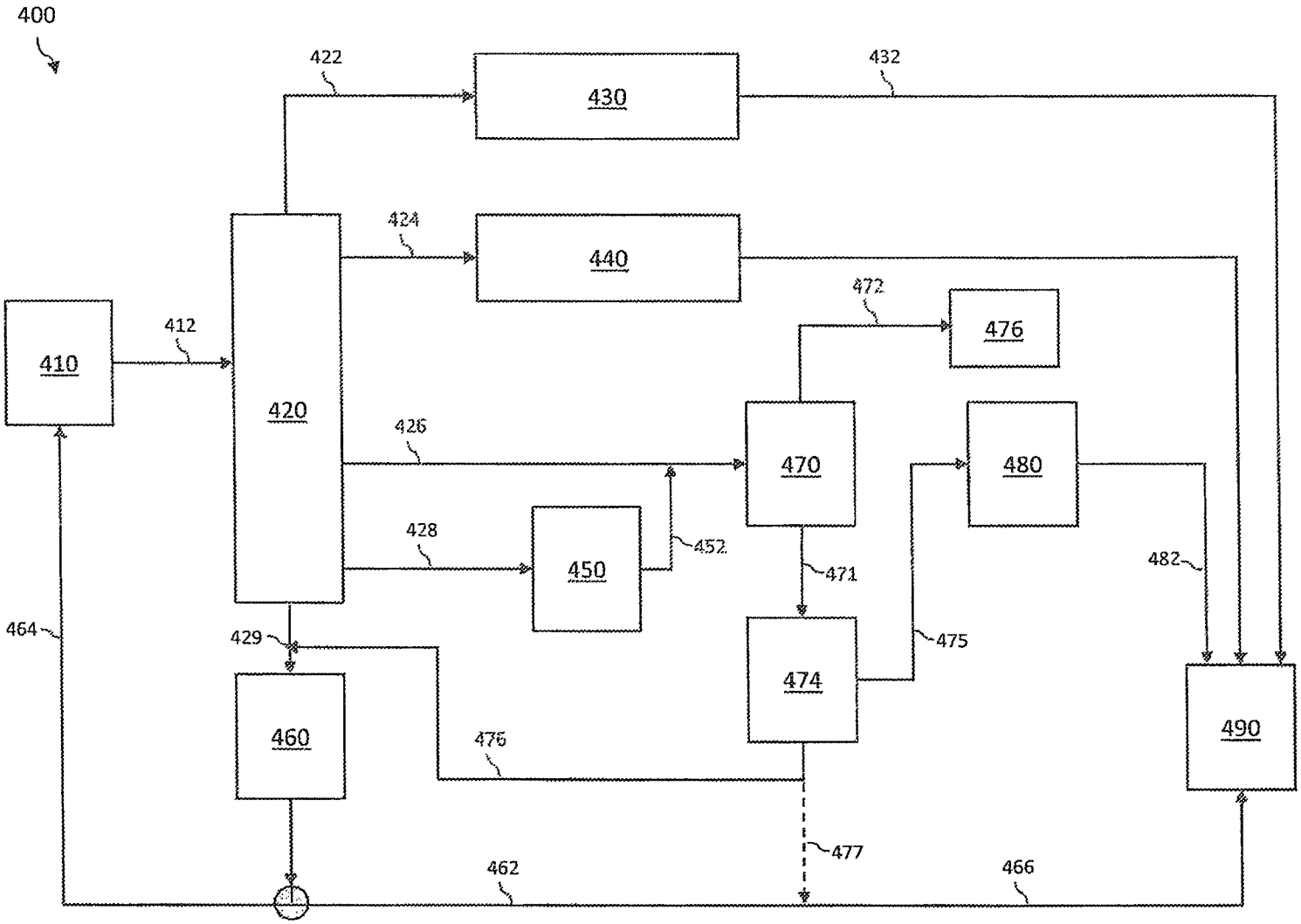
FIG. 4 is a simplified schematic diagram of another embodiment of the system and process of the present disclosure that includes a splitter downstream of the aromatic extraction unit.

Another embodiment of the process and system of the present disclosure will be described with reference to FIG. 4 in which all of the principal elements of the system (400) and process correspond to those described above in connection with the system (300) of FIG. 3. Thus, the third fraction (426), boiling in the range of from 100° C. to 150° C. is passed to an aromatic extraction zone (470) which can comprise a solvent extraction unit which includes means for separating the aromatics from the solvent and recovery of the aromatics (472) for further processing in a downstream unit (476). The fourth fraction (428) boiling from 150° C. to 180° C. is passed to a hydrotreating zone (450) and the hydrotreated stream (452) is passed to the aromatic extraction zone (470) where it is processed with the third fraction (426). This fourth fraction is high in aromatic content, with more than 30% of the weight percent of aromatics present in the 100° C. to 150° C. fraction (426). The fifth and final fraction (429) comprises those components boiling at 180° C. and up to the maximum boiling point (MBP) of the cracked naphtha feed. The final fraction is passed to high pressure hydroprocessing zone (460) for appropriate treatment depending upon the composition of the fraction. In the embodiment as illustrated in FIG. 4, a splitter (474) receives the aromatic-lean raffinate stream (471) from the aromatics extraction zone (470). The stream of components having a boiling point of 150° C. and lower (475) is passed to the hydrotreating zone (480) which functions as the hydrotreater (380) in FIG. 3. The second stream from the splitter (474) having boiling points above 150° C. (476) is recycled in whole or part as stream (476) and mixed with the fifth fraction (429) and introduced into hydroprocessing zone (460). A portion of the 150° C.+ stream (476) can be passed to the gasoline blending pool (490), e.g., in admixture with the hydroprocessed stream (462) to form mixed stream (466).

Figure 5:
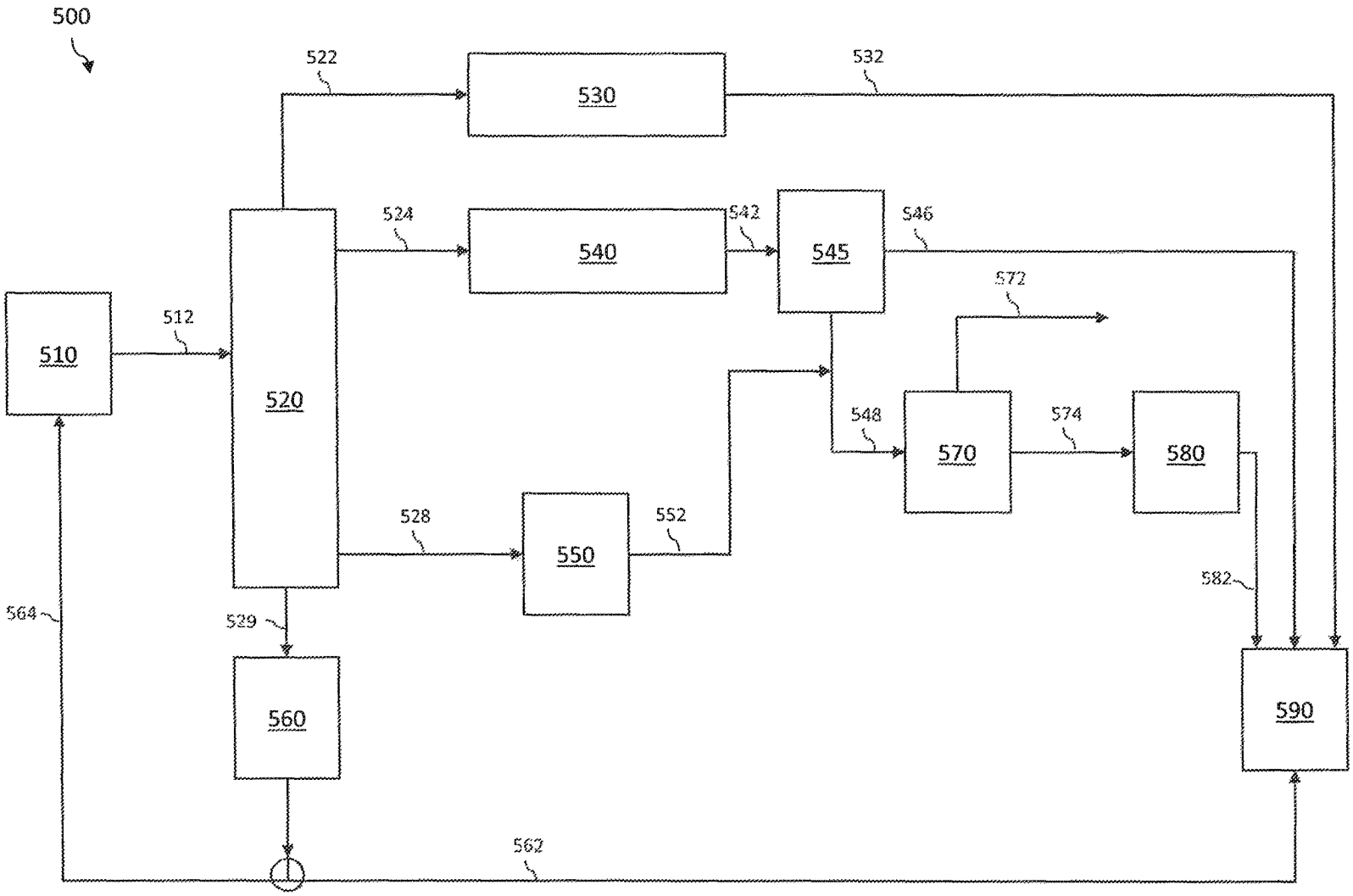
FIG. 5 is a simplified schematic diagram of further embodiment of the system and process of the present invention similar to FIG. 4, but in which the splitter is upstream of the aromatic extraction unit with a wider boiling point range stream fed to the selective hydrogenation unit.

A further embodiment of the process and system in the present disclosure will be described with reference to FIG. 5 in which the system (500), as depicted, differs in several respects from the processes and systems of FIGS. 3 and 4. It is noted that the second fraction encompasses broader cut points of from 50° C. to 150° C. (524) and this stream is passed to the selective hydrogenation zone (540). The treated stream (542), which is substantially free of diolefins and has a lower sulfur content, is passed to splitter (545) in which the components boiling from 50° C. to 100° C. (546) is recovered and passed directly to the gasoline pool (590). The component stream boiling from 100° C. to 150° C. (548) is passed to the aromatic extraction zone (570).

The third fraction (528) from the distillation unit (520) boiling from 150° C. to 180° C. is passed to hydrotreating zone (550) and the hydrotreated stream (552) is introduced into the aromatic extraction zone (570) for processing with the 100° C. to 150° C. component stream (548) from splitter (545). Subsequent treatment of these components streams (572, 574) in the embodiment of system (500) is the same as previously described for system (300) in conjunction with FIG. 3.

Figure 6:
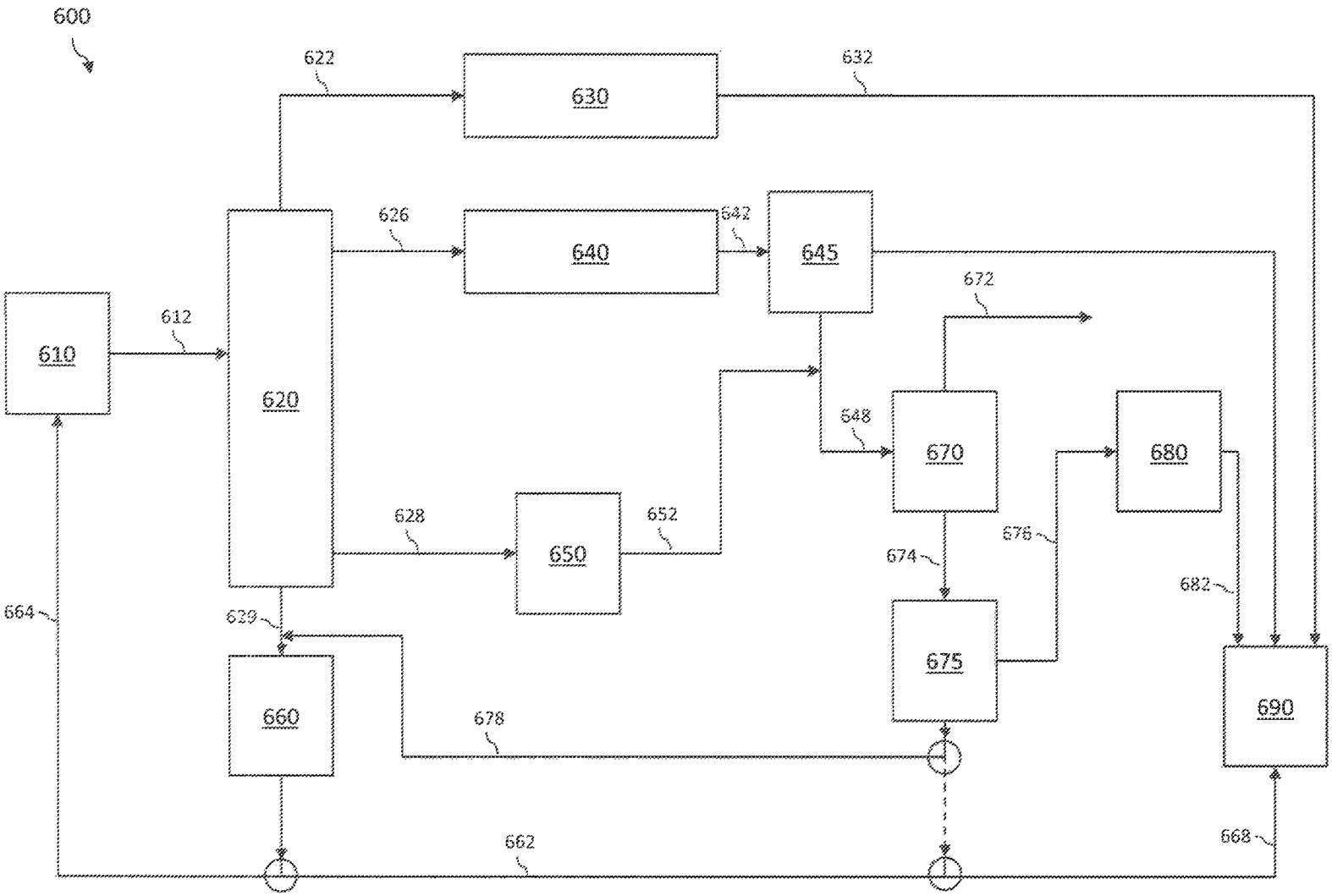
FIG. 6 is a simplified schematic diagram of another embodiment of the system and process of the present invention similar to FIG. 5 which includes splitters upstream and optionally downstream of the aromatic extraction unit with recycle of the heavy fraction to the hydroprocessing unit and optionally a partial recycle to the FCC unit.

An additional embodiment of the process and system of the present disclosure will be described with reference to FIG. 6. The system (600) of FIG. 6 is similar to the system (500) described in conjunction with FIG. 5. The third fraction (628) from the distillation column (620) is passed to a hydrotreating zone (650). The system (600) of FIG. 6 differs by the inclusion of a second splitter (675) downstream of the aromatic extraction zone (670), from which the aromatic stream (672) is recovered. This second splitter (675) receives the aromatic-lean raffinate stream (674) which is split into a component (676) boiling at 150° C. and below, and a component with a boiling point above 150° C. (678), an operation that is functionally similar to that of the splitter (474) in FIG. 4. The lighter fraction (676) with an upper boiling point of 150° C. is passed to the hydrotreating zone (680) and the hydrotreated product stream (682) is passed to the gasoline blending pool (690). The components from the splitter (675) boiling above 150° C. and up to 180° C. (678) are returned in whole or part for admixture with the fourth fraction (629) from the distillation unit (620) with a boiling point above 180° C. up to the MBP of the fraction.

As will be understood from the above descriptions, the processes of FIGS. 4 and 6 which employ a splitter result in a downstream increase in the first, second and third fractions, and also an increase in the yield of aromatics due to the hydroconversion of the respective splitter bottoms streams.

Each of the splitters described in the several embodiments of the process function in a manner that is similar to a distillation tower where the heating is provided by a bottom boiler and which has a number of plates in order to ensure the desired degree of separation between the top and bottom product streams. As is shown in the schematic flow diagrams, only two products are withdrawn from the splitter, e.g., one from the top and the other from the bottom. The operating temperature and pressure of each splitter are based on the predetermined cutting temperature, which is, by definition, implied in the respective stream temperature ranges.

Thereafter, the subsequent processing and passage of the treated streams are substantially as previously described in conjunction with the earlier embodiments.

Figure 7:
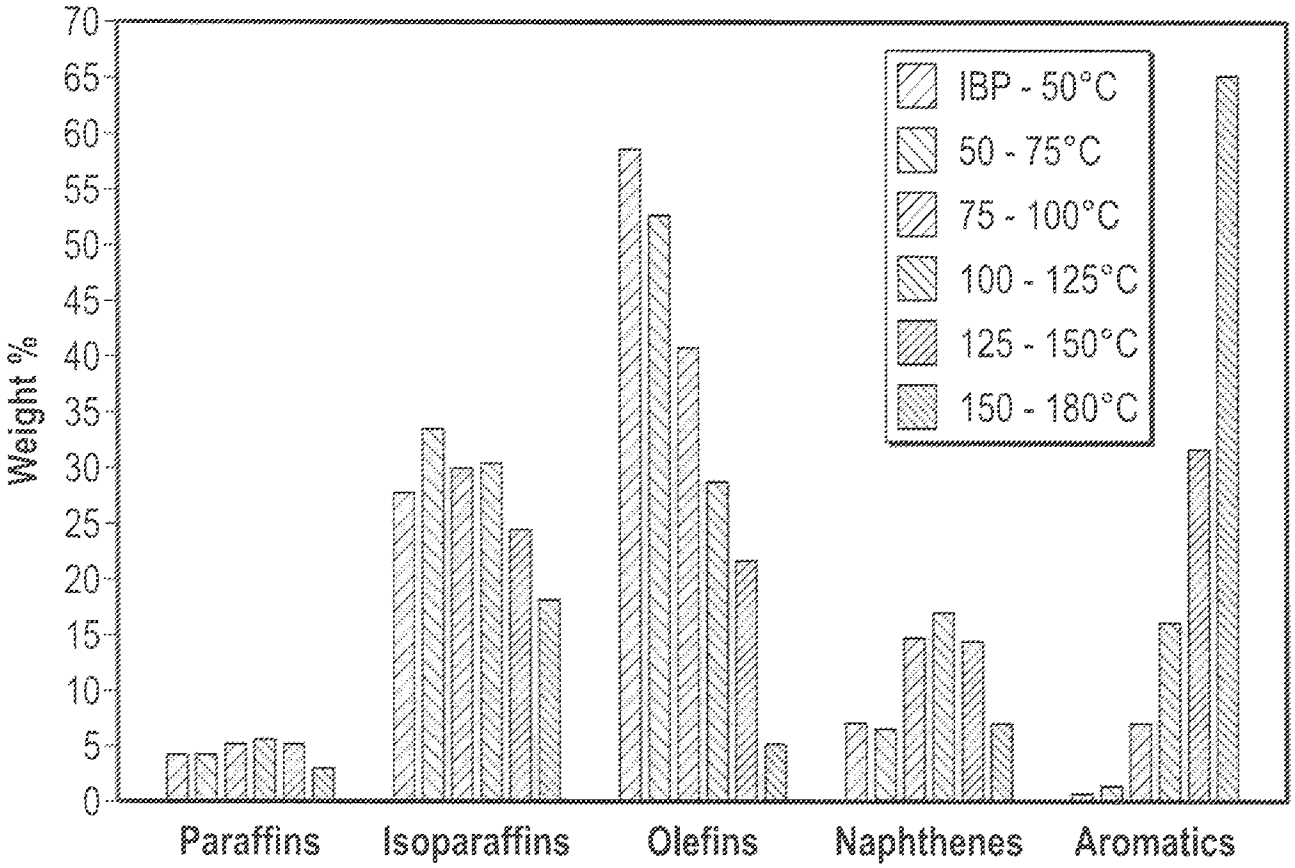
FIG. 7 is a chart showing the compositional analysis of each of six cuts of fractionated sample of FCC naphtha.
Figure 8:
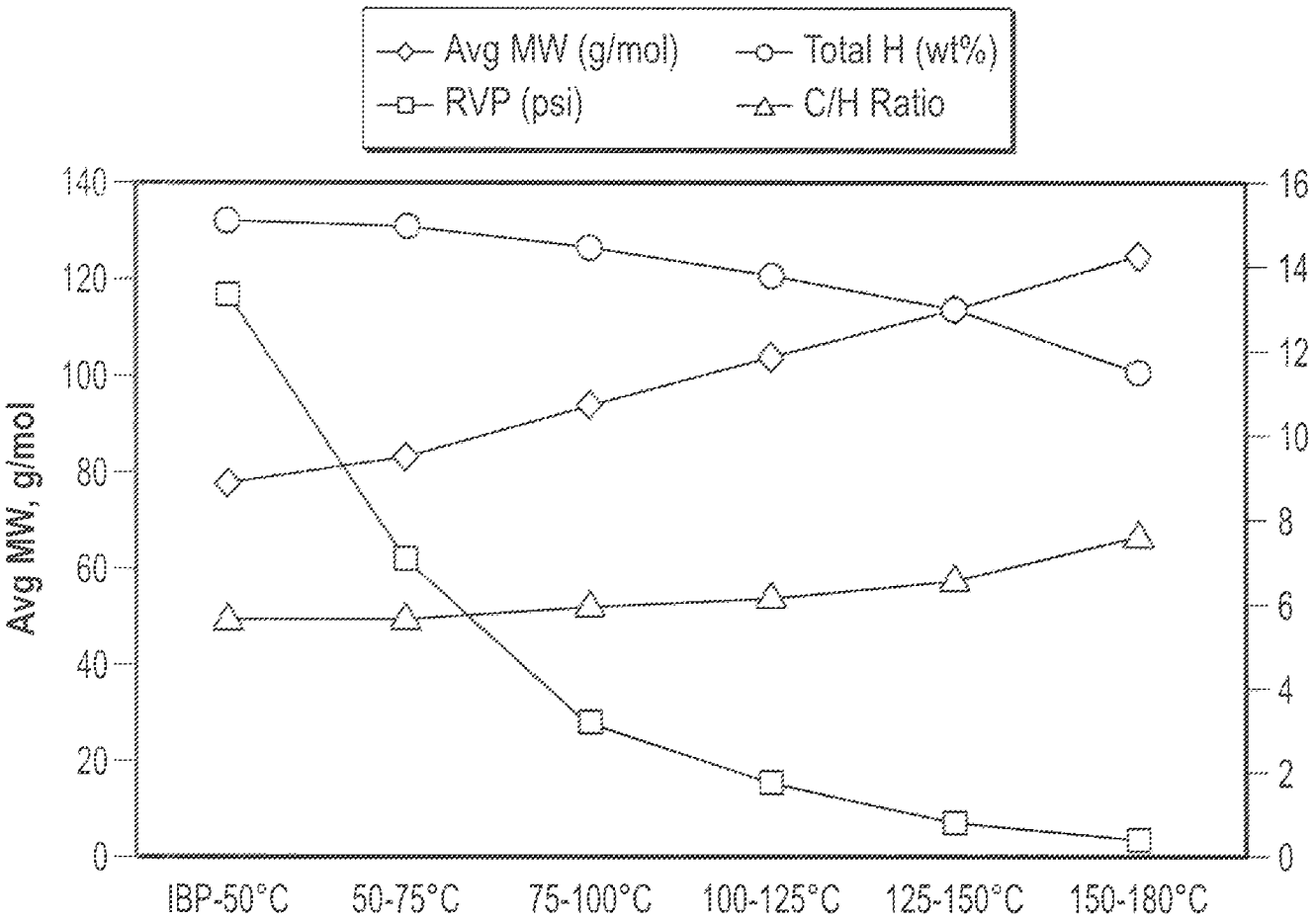
FIG. 8 is a plot of Reid vapor pressure values and other characteristics of the six fractions of cracked naphtha identified in FIG. 7.
Figure 9:
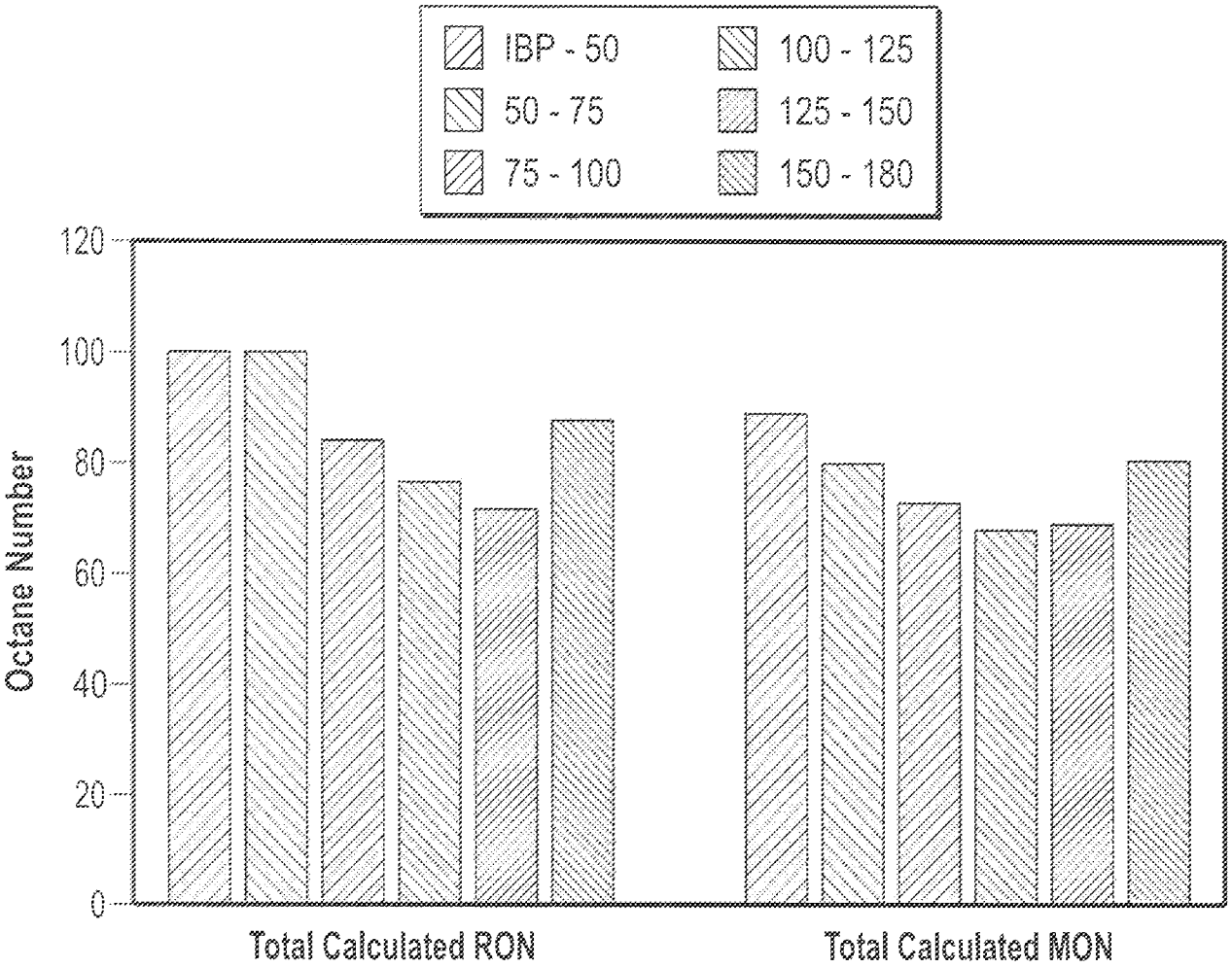
FIG. 9 is a plot of the Research Octane Number (RON) and the Motor Octane Number (MON) for the six fractions identified in FIG. 7.

The following discussion and description of the composition and characteristics of the fractions cut from the FCC naphtha stream in accordance with the invention will be best understood with reference to FIGS. 7-9. FCC naphtha, and cracked naphthas in general, contain large proportions of olefins and aromatics. An FCC naphtha was fractionated using lab distillation equipment and the compositional analysis by GC of the six cuts from the IBP to 180° C. are shown in FIG. 7. The distillation efficiency was assessed to ensure the actual cut range. Each fraction was also analyzed for its RON, sulfur content, RVP value, and simulated distillation, among other analyses.

Referring to the chart of FIG. 8, plots for each of the six cuts are shown, where the average molecular (g/mol) corresponds to the values on the y-axis to the left, and the value of the Reid vapor pressure (RVP) (psi), total hydrogen as a weight percent (wt %), and the ratio of C/H corresponds to the values on the y-axis to the right of the plots. The increase in molecular weight and the reduction in hydrogen content indicate the changes in the composition of the heavier feedstocks that typically have a higher aromatics content as the boiling point increases. This result is further indicated by the increase in the C/H ratio.

The calculated Research Octane Number (RON) and Motor Octane Number (MON) for each of the six cracked naphtha fractions are graphically plotted in FIG. 9. It is to be noted that the two highest values of the RON are obtained from the first two fractions, i.e., from the IBP to 75° C. These two fractions will contribute significantly to the final RON of the commercial gasoline blend formulated from the blending pool. As such, they are high value components.

Referring to Table 1, data is provided for the density, nitrogen and sulfur content obtained from the analysis of seven (7) distillation cuts taken at 25° C. temperature intervals after the initial IBP-50° C. cut and up to 150°-180° C. and the final cut of 180° C.+. The analysis of the complete FCC naphtha stream from which the distillation data was obtained is also provided. As shown in Table 1, the nitrogen content of the 150° C.-180° C. fraction was significantly greater than the lower boiling fractions. The sulfur content of all of the fractions of this naphtha stream exceeded the common regulatory benchmark of 10 ppm with a greater than 100-fold increase in the 150° C.-180° C. cut. However, in an embodiment of the process, the lightest fraction with a sulfur content in the low double digit range can be sent directly to the gasoline blending pool for blending with lower sulfur content components so that the blended components withdrawn from the pool for distribution as motor vehicle fuels will not exceed the regulatory maximum sulfur value.

TABLE 1

| Fraction | Normalized Yield of Fraction (wt %) | Density (g/mL) | Nitrogen Content (ppm) | Sulfur Content (ppm) |
|---|---|---|---|---|
| IBP-50 | 10.2 | 0.6547 | 1 | 13 |
| 50-75 | 13.7 | 0.6891 | 1 | 200 |
| 75-100 | 11.0 | 0.723 | 1 | 300 |
| 100-125 | 15.1 | 0.7532 | 1 | 750 |
| 125-150 | 11.9 | 0.7846 | 1 | 1100 |
| 150-180 | 17.7 | 0.8168 | 6 | 1400 |
| 180+ | 20.4 | 0.8735 | 68 | 14500 |
| FCC Naphtha | 100 | 0.7648 | 14 | 4000 |

As is clearly shown by the analytical data presented in Table 1, the most problematic fraction in terms of nitrogen- and sulfur-containing compounds is that boiling above 180° C. which accounts for only about 20 weight % of the feed and yet contains the most sulfur- and nitrogen-containing compounds.

Aromatics can be recovered to maximize the value of the FCC naphtha and adhere to any regulatory or other limitations on the content of benzene and/or other aromatic compounds in the blended gasoline. The process of the present disclosure maximizes the amount of aromatics extracted by increasing the range of the boiling points of the fraction of the feed sent to the aromatic extraction unit, and by recycling the heaviest fraction after the hydrotreating and/or mild hydrocracking of the fraction. By recycling the stream after hydrotreating, hydrogenation and mild hydrocracking, more extractable aromatics are produced in the desired range which results in a better quality raffinate for the gasoline blending pool. The benefits and advantages of separating the various process treatment steps in accordance with the present disclosure are to minimize the cost of hydrotreating and/or decrease the size of the reactor vessels since the most refractory fraction treated is relatively small as compared to the volume of the initial feedstream.

The lightest fraction is optionally processed in an alkylation or selective etherification step to reduce the RVP value and to increase the RON of this stream prior to sending it to the gasoline blending pool when these characteristics require modification to meet specifications for the pool.

In summary, the present improved integrated refinery process for treating cracked naphtha to produce aromatics and components for gasoline blending comprise the steps of fractionating the cracked naphtha into five, or alternatively, four fractions based on boiling points to provide: a first light fraction that has no aromatics and a substantial amount of olefins which can typically range from greater than 50 weight % up to about 60 weight % and that can include C4-C7 components with a boiling point below 50° C., a second fraction with an initial boiling point in the range that is the final boiling point of the first fraction and up to either 100° C. or 150° C. containing a substantial proportion of aromatics and olefins, a third fraction with an initial boiling point which is the same as final boiling point of the second fraction and a final boiling point that is either 150° C. or 180° C. a fourth fraction with an initial boiling point which is the same as the final boiling point of the third fraction and a final boiling point that is either 180° C. or the MBP of the feed entering the fractionation column, and in the alternative, a fifth fraction that with an initial boiling point that is the final boiling point of the fourth fraction and a final boiling point that is the MBP of the feed.

As will be understood from the above descriptions, the present process differs from the prior art Timken et al and Mehlberg et al processes by increasing the number of fractions and specify the temperature ranges of the fractions, or cuts, for the purpose of maximizing the recovery of aromatics. The lightest fraction with a maximum boiling point cut off of 50° C. is optionally directed to a selective etherification process or an alkylation process to reduce the RVP value and to maintain or increase the RON value of the fraction. The heaviest fraction is hydrotreated and/or mildly hydrocracked prior to recycling a portion to the FCC unit and/or sending a portion directly to the gasoline blending pool. The embodiments described above provide additional benefits and offer alternative means to achieve the advantages of increasing the value of the cracked naphtha stream.

The process can also be distinguished by the further splitting of the heavier products to maximize the production of aromatics by further cracking of the 180° C.+ fraction and recovering a portion of the cracked products for use in the gasoline pool.

From the above description, it will also be understood that the hydrotreating step is improved by segmenting the product stream, e.g., by fractionation and/or use of the splitter, into those portions that require hydrotreating in order to maximize efficient utilization of the equipment to its design capacity and optimize utilization of the hydrogen supply.

In addition, the selective partial recycling of the heaviest fraction of 180° C. and above further enhances the recovery of gasoline and gasoline blending components to maximize the value of the original cracked naphtha stream.

In retrospect from the vantage provided by the present disclosure, the main disadvantage of Timken et al. is that the fraction identified for aromatic production is narrow, i.e., between 150°-300° F./77°-150° C. The range was widened by Mehlberg et al. to reference it to carbon chain lengths of at least C6-C9, which would result in an aromatic yield comparable to the present disclosure prior to the partial recycling of the heavy stream to the FCC unit. However, the present process differs significantly with respect to (1) the processing of the very light first fraction, (2) the separate hydrotreating of the different fractions, and (3) by the partial recycling of the heavy ends of the specified fraction to the FCC unit for further processing. This latter distinction is in contrast to the processes of both Timken et al and Mehlberg et al which send the heavy fraction after hydrotreating directly to the gasoline blending pool.

The process of the present disclosure maximizes the aromatics extracted by increasing the range of the boiling points of the fractions sent to the aromatic extraction unit and also by recycling the heaviest fraction remaining after the hydrotreating and/or mild hydrocracking unit. Further processing of the remainder of these fractions after hydrotreating, hydrogenation and mild hydrocracking produces more extractable aromatics in the desired range and provides a better quality raffinate for gasoline blending. As explained above, by separating the fractions for treatment, the cost of hydrotreating is minimized by reducing the hydrogen requirement and the capital cost for the hydrotreating vessel in the case of new construction, since the most refractory fraction is relatively small compared with the initial feed of cracked naphtha from the FCC unit. Moreover, the very light first fraction can optionally be upgraded to increase the value of the product prior to sending it to the gasoline blending pool. The light fraction can be passed to an alkylation or selective etherification unit to reduce the RVP value and further increase its RON. The cumulative outcome is increased value for the FCC naphtha compared with prior art processes and current commercial practices.

Although the invention has been described in detail above and in the embodiments illustrated in the attached drawing, modifications and variations of the process will be apparent to those of skill in the art, and the scope of the invention is to be determined by the claims that follow.

The invention claimed is:

1. A process for treating a feedstream of cracked naphtha to produce aromatics and gasoline blending components, the process comprising:

a. introducing the feedstream into a fractionating column and fractionating the cracked naphtha into five fractions based on boiling point ranges in which
   i. a first fraction has a boiling point ranging from the initial boiling point (IBP) of the feed up to 50° C., contains no or substantially no aromatics and comprises a substantial proportion of the olefins present in the original cracked naphtha feed,
   ii. a second fraction has an initial boiling point that is the final boiling point of the first fraction and a final boiling point of 100° C.,
   iii. a third fraction has an initial boiling point that is the final boiling point of the second fraction and a final boiling point of 150° C.,
   iv. a fourth fraction has an initial boiling point that is the final boiling point of the third fraction and a final boiling point of 180° C., and
   v. a fifth fraction has an initial boiling point that is the final boiling point of the fourth fraction and a final boiling point that is the maximum boiling point (MBP) of the cracked naphtha feed entering the fractionation column;

b. passing the first fraction for processing to reduce the RVP value by subjecting the fraction to a selective etherification or alkylation process and directing the treated stream to a gasoline blending pool;

c. passing the second fraction to a selective hydrogenation processing zone to catalytically convert diolefins to mono-olefins and light sulfur components into heavier sulfur-containing components;

d. passing the selectively hydrogenated product stream of step (c) to the gasoline blending pool;

e. optionally passing the third fraction to a selective hydrogenation unit to catalytically convert diolefins to mono-olefins and passing the selectively hydrogenerated stream or the untreated third fraction to an aromatics extraction unit;

f. passing the fourth fraction to a hydrotreating unit and passing the hydrotreated stream and the third fraction to the aromatics extraction unit;

g. recovering from the aromatic extraction unit an aromatic rich stream, which is directed for further aromatic processing, and an aromatic-lean stream composed mainly of paraffins, isoparaffins, and olefins, and passing the aromatic-lean stream to a hydrotreating unit, and passing the hydrotreated stream to the gasoline blending pool; and h. passing the fifth fraction to a hydroconverting unit and passing all or a predetermined portion of the hydroconverted product stream to an FCC unit as a recycle stream and passing any remaining portion to the gasoline blending pool.

2. The process of claim 1, wherein the boiling cut point of the second fraction is 75° C., whereby the boiling range of the second fraction is from 50° to 75° C. and the boiling range of the third fraction is from 75° to 150° C.

3. The process of claim 1, wherein the third fraction is passed to a common hydrotreating unit with the fourth fraction without further hydrotreating downstream of the aromatic extraction unit.

4. The process of claim 1, wherein the third fraction is sent directly to the aromatic extraction unit.

5. The process of claim 1, wherein the final boiling point of the first fraction is 50° C.

6. The process of claim 1, wherein the selectively hydrogenated stream is hydrotreated to reduce its sulfur content.

7. The process of claim 1, wherein the third fraction is sent to a common hydrotreating unit with the fourth fraction prior to the aromatics extraction unit.

8. The process of claim 1, wherein all of the fifth fraction is recycled to FCC unit after the hydroconverting unit.

9. The process of claim 1, wherein all of the fifth fraction is sent to the gasoline pool after the hydroconverting unit.

10. The process of claim 1, wherein the third fraction is passed to a separate hydrotreating unit before it is mixed with the hydrotreated fourth fraction upstream of the aromatics extraction unit.

11. A process for treating a feedstream of cracked naphtha to produce aromatics and gasoline blending components comprising:

a. fractionating the cracked naphtha into four fractions based on boiling point in which:
   i. the first fraction having a boiling point below 50° C. that contains no or substantially no aromatics and a substantial proportion of olefins present in the original cracked naphtha feed,
   ii. a second fraction having an initial boiling point that is the final boiling point of the first fraction and a final boiling point of 150° C. that contains a substantial proportion of the aromatics and olefins present in the original feed,
   iii. a third fraction having an initial boiling point that is the final boiling point of the second fraction and a final boiling point of 180° C., and
   iv. a fourth fraction with an initial boiling point that is of the final boiling point of the third fraction and a final boiling point that is the maximum boiling point (MBP) of the feed entering the fractionation column;

b. optionally passing the first fraction for processing to reduce the Reid vapor pressure (RVP) value and increase the research octane number (RON) by subjecting the fraction to a selective etherification or alkylation process and directing the treated stream or untreated first fraction to a gasoline blending pool;

c. passing the second fraction to a selective hydrogenation process to catalytically convert the corresponding diolefins to mono-olefins;

d. passing the selectively hydrogenated product to a splitter operating under predetermined conditions to divide the product into two streams based on boiling point, and recovering from the splitter a first light stream having a boiling not exceeding 100° C. and a second heavy stream boiling up to the final boiling point of the selectively hydrogenated product, wherein the first light stream is sent directly to the gasoline blending pool without further hydrotreatment, and the second heavy stream is sent to an aromatic extraction unit;

e. passing the third fraction to a hydrotreating unit, recovering and combining the hydrotreated third fraction with the second heavy stream from the splitter prior to passing the combined streams to the aromatic extraction unit;

f. recovering from the aromatic extraction unit an aromatic-lean stream comprising as a major proportion paraffins, isoparaffins and olefins, the aromatic-lean stream being passed to a hydrotreating unit, and passing the hydrotreated stream to the gasoline blending pool, where the hydrotreating unit care be placed upstream or downstream of the aromatic extraction unit; and g. passing the fourth fraction to a hydroconverting unit and passing all or a portion of the hydroconverted stream to either an FCC unit as a recycle stream or to the gasoline blending pool.

12. The process of claim 11, wherein the Reid vapor pressure value of the first fraction is decreased by passing the first fraction for treatment to an alkylation unit or a selective etherification unit.

13. The process of claims 11 or 12, wherein the first fraction is subjected to a selective etherification process.

14. The process of claim 13, wherein the selective etherification process employs an alcohol under acidic conditions and reaction temperatures ranging from 20° to 80° C.

15. The process of claim 14, wherein the alcohol is methanol.

16. The process of claim 11, wherein the splitter in step 11(d) separates the selectively hydrogenated stream into a light stream boiling in the range of 50°-75° C. and a heavy stream boiling in the range of 75°-150° C.

17. The process of claim 16, wherein the light stream from the splitter contains sulfur compounds and is hydrotreated to reduce the sulfur content.

18. The process of claim 11, wherein the aromatic extraction unit utilizes a solvent extraction process operated in the range of 50-150° C., wherein the solvent is selected from the group comprising sulfolane, mono-ethylene glycols and/or multi-ethylene glycols, and dimethyl sulfoxide, alone and in combination.

19. The process of claim 18, wherein the solvent extraction process is operated at 120° C.

20. The process of claim 18 wherein the multi-ethylene glycols are diethylene glycols and tetraethylene glycols, alone and in combination.

21. The process of claim 11, wherein the aromatic-lean fraction recovered in step 11(f) is further split into two fractions at a cut point of 150° C. to provide a light stream and a heavy stream, and the light stream is passed to a hydrotreating unit and the hydrotreated stream is passed to the gasoline blending pool.

22. The process of claim 21, wherein the heavy stream derived from the aromatic-lean fraction is mixed with the hydroconverted stream of step 11(g).

23. The process of claim 22, wherein the cracked naphtha is produced in an FCC unit and all or a predetermined portion of the two mixed streams are recycled to the FCC unit and any portion remaining is sent to the gasoline blending pool.

24. The process of claim 23, wherein all of the mixed streams are combined and recycled to the FCC unit.

25. The process of claim 23, wherein all of the mixed streams are combined and sent to the gasoline blending pool.

26. The process of claim 11, wherein the fourth fraction is subjected to a hydroconversion process selected from hydrotreating, partial hydrogenation and mild hydrocracking.

27. The process of claim 11, wherein all or a predetermined portion of the hydroconverted fourth fraction is recycled to an FCC unit and any remaining portion is sent to the gasoline blending pool.

28. The process of claim 27, wherein all of the hydroconverted fourth fraction is recycled to the FCC unit.

29. The process of claim 27, wherein all of the hydroconverted fourth fraction is passed to the gasoline blending pool.

30. The process of claim 11, wherein the selective hydrogenation product is admixed directly with the third hydrotreated fraction and the mixed stream is passed to the aromatics extraction unit.

31. The process of claim 11, wherein the hydrotreating of the aromatic lean stream of step 11(f) occurs in a hydrotreating unit upstream of the aromatic extraction unit.

32. The process of claim 11, wherein the hydrotreating of the aromatic lean stream of step 11(f) occurs in a hydrotreating unit downstream of the aromatic extraction unit.

* * * * *